United States Patent [19]

Whistle

[11] 3,934,655

[45] Jan. 27, 1976

[54] HYDRAULIC POST SETTING AND WIRE DISPENSING APPARATUS

[75] Inventor: Bobby A. Whistle, Texarkana, Ark.

[73] Assignee: Whistle Hydraulics, Inc., Garland, Ark.

[22] Filed: Jan. 29, 1974

[21] Appl. No.: 437,737

Related U.S. Application Data

[63] Continuation-in-part of Ser. No. 223,136, Feb. 3, 1972, abandoned.

[52] U.S. Cl. ..... 173/46; 173/28; 173/122; 173/126; 242/86.5

[51] Int. Cl.[2] ..... E04B 17/26

[58] Field of Search ..... 173/46, 53, 81, 147, 28, 173/126, 22, 152, 112, 124, 122, 159; 242/86.5; 254/64, 29

[56] References Cited

UNITED STATES PATENTS

| | | | |
|---|---|---|---|
| 626,107 | 5/1899 | Starling | 254/64 X |
| 2,776,114 | 1/1957 | Brown | 173/147 |
| 2,952,132 | 9/1960 | Urban | 173/126 |
| 3,117,635 | 1/1964 | Peerkoski | 173/43 X |
| 3,369,616 | 2/1968 | McGonigal et al. | 173/124 |
| 3,645,343 | 2/1972 | Mays | 173/147 X |

*Primary Examiner*—Frank L. Abbott
*Assistant Examiner*—William F. Pate, III
*Attorney, Agent, or Firm*—Clarence A. O'Brien; Harvey B. Jacobson

[57] ABSTRACT

A tractor mounted, hydraulically actuated, manually controlled, fence post setting and fence wire reeling apparatus including a post driving assembly having a vertically guided, reciprocal weight, a hydraulic motor for lifting the weight and a unique sprocket chain drive assembly interconnecting the motor and weight. The apparatus also includes a multiple fence wire reel assembly with each reel including a spool connected to a hydraulic power device which operates either in a motor mode or pump mode to enable fence wire to be reeled onto the spools or unreeled therefrom with a desired adjustable tension. The apparatus is mounted on a conventional three-point hitch of a farm tractor and the post setting assembly is mounted for lateral swinging movement in order to orient the post in desired alignment and to position the post setting assembly in an out-of-the-way position when the fence wire is being reeled.

10 Claims, 9 Drawing Figures

HYDRAULIC POST SETTING AND WIRE DISPENSING APPARATUS

CROSS REFERENCE TO RELATED APPLICATION

This application is a continuation-in-part of my copending application U.S. Ser. No. 223,136, filed Feb. 3, 1972 for Post Setting and Wire Dispensing Apparatus and now abandoned.

BACKGROUND OF THE INVENTION

1. Field of the Invention

The present invention generally relates to a fence post driving and fence wire reeling apparatus adapted to be mounted on a farm tractor to facilitate the stringing of a fence of from one to five strands of wire with uniform tension and also to rewind the wires when desired. The post driver guides the post and drives it without splitting and can swing laterally of a tractor for positioning of the post driver and the post driver can be leveled into a plumb position.

2. Description of the Prior Art

Fence post driving and fence wire reeling apparatuses are known and facilitate to a certain degree the stringing of a fence or removal of a fence when desired. The following prior patents are exemplary of the known devices for setting or removing fence posts, reeling or unreeling fence wires and providing power reels for reeling or unreeling cable and providing power hammer devices for general utility. U.S. Pat. Nos. 626,107, issued May 30, 1899; 1,128,131, issued Feb. 9, 1915; 1,443,689, issued Jan. 30, 1923; 2,476,390, issued July 19, 1949; 2,659,583, issued Nov. 17, 1953; 2,665,081, issued Jan. 5, 1954; 2,759,684, issued Aug. 21, 1956; 2,940,267, issued June 14, 1960; 3,037,720, issued June 5, 1962; 3,079,129, issued Feb. 26, 1963; 3,100,530, issued Aug. 13, 1963; 3,104,863, issued Sept. 24, 1963; 3,490,548, issued Jan. 20, 1970; and 3,658,270, issued Apr. 25, 1972.

SUMMARY OF THE INVENTION

An object of the invention is to provide a fence post setting assembly and fence wire reeling assembly incorporating a plurality of reels or spools for reeling out or taking up one or a plurality of fence wires under uniform tension conditions and set a post in an accurate vertical position and in a desired laterally adjusted position in relation to a tractor on which the apparatus is mounted.

Another object of the invention is to provide a post driving apparatus in the form of a vertically guided reciprocal weight which is elevated and dropped onto the upper end of a post with the post being received in guide means for retaining vertical positioning of the post together with mounting means for the post driving apparatus to enable it to swing laterally about a pivot point in order to enable a post to be driven even though it may be laterally spaced from a supporting tractor.

A further object of the invention is to provide a wire reeling apparatus in which each reel or spool is directly connected to a hydraulic power unit which may be operated in a motor mode or pump mode for reeling or unreeling wire under uniform tension from one or all of the reels.

Another object of the invention is to provide a post driving and wire reeling apparatus adapted to be attached to a three-point hitch of a farm tractor and incorporates a leveling feature therein to properly orient the apparatus in relation to the terrain with the apparatus being relatively simple in construction, dependable and long lasting, easy to install and operate and resulting in a substantial labor saving when stringing a fence.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figures 1, 8:
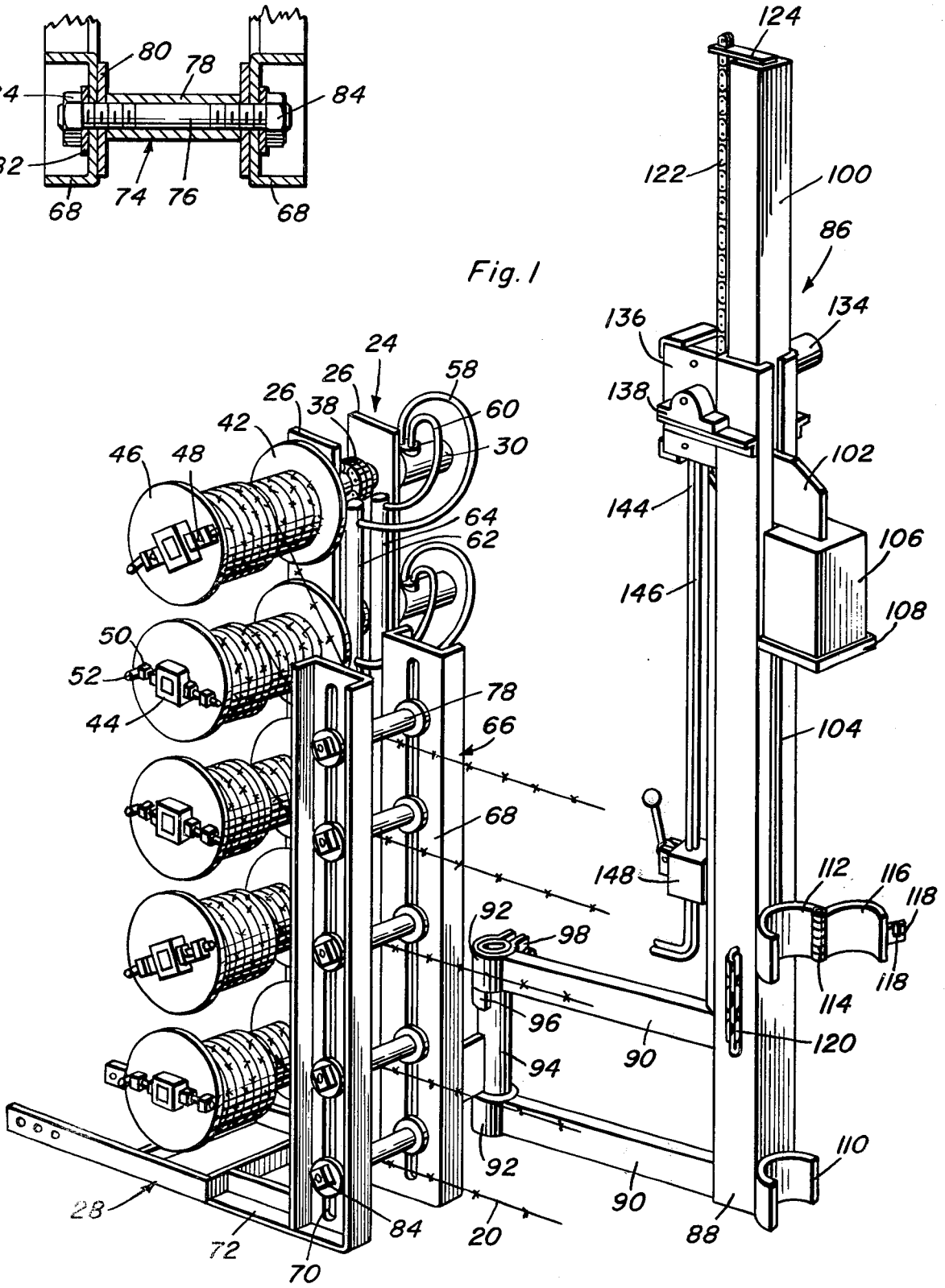
FIG. 1 is a perspective view of the post setting and wire reeling apparatus.
FIG. 8 is a sectional view of a wire guide.

The fence post driving and wire reeling apparatus of the present invention is generally designated by reference numeral 10 and is mounted on a conventional three-point hitch assembly generally designated by the numeral 12 of a conventional farm tractor 14 of the type having a hydraulic power system which controls the elevational position of the three-point hitch assembly 12 and also supplies hydraulic power for operation of the apparatus 10. The apparatus 10 is utilized to drive posts 16 into the ground surface 18 and to string one or a plurality of fence wires 20 alongside of the posts 16 so that they may be secured thereto by staples 22 or the like. As illustrated, five barbed wire strands 20 may be strung at one time although this number may be varied depending upon the particular requirements of each fence.

The wire reeling and unreeling apparatus is generally designated by the numeral 24 and includes a pair of vertically extending, parallel supporting members 26 in the form of plates which have their lower ends rigidly fixed to a framework generally designated by numeral 28. A plurality of hydraulic motors 30 are supported from one of the plates 26 by brackets 32 with the motors 30 being drivingly connected to a shaft 34 journaled in bearing blocks or assemblies 36 fixedly attached to the other of the plates 26. The output of each motor 30 is connected to the shaft 34 by a coupling 38 in the form of two adjacent sprocket gears and an encircling chain. This enables separation of the motor and shaft to facilitate assembly and replacement of components. The end of the shaft 34 remote from the motor 30 is provided with a wire spool generally designated by numeral 40 and which includes a circular disk or plate 42 at the inner end thereof and a square hub 44 which fits into existing wire spools on which barbed wire is normally stored or if desired, wire can be reeled directly onto the hub 44. The outer end of the hub 44 is provided with a circular disk 46 which has an aperture therein receiving the hub 44 so that the plate 46 may be removed for placing a spool of wire onto the hub 44 or removing a spool of wire therefrom. To releasably secure the plate 46 in position, the plate is provided with a pair of diametrically opposed radially movable latch members 48 which are slidably mounted in sleeves 50 and provided with a laterally extending handle 52 at the outer end thereof by which the inner ends of the latches 48 may be moved into engagement with a plurality of longitudinally spaced apertures 54 in the hub 44 thereby releasably and adjustably securing the plate or disk 46 to the hub 44.

The plates 26 may be spaced by spacer bolts 56 and the hydraulic motors 30 are powered by hydraulic fluid supplied through flexible conduits or hoses 58 and 60 which are connected respectively to manifolds 62 and 64 which are vertically oriented and disposed alongside of the plates 26 to supply hydraulic fluid through either of the hoses 58 and 60 thereby driving the motors in reverse directions or enabling the motors 30 to be operated in a motor mode or in a pump mode in which the motor actually pumps hydraulic fluid so that uniform tension may be exerted on each of the wire strands 20 regardless of whether the strand is being wound onto the reel or spool 40 or being unwound therefrom.

Oriented rearwardly of the reel assembly 24 is a guide assembly generally designated by numeral 66 which includes vertically disposed support members 68 which are in spaced parallel relation to each other and may be in the form of channel-shaped members or two right-angular members secured together with each support member 68 including a vertically elongated slot 70. The lower ends of the members 68 are secured to the frame 28 by bracket structures 72 which may be welded into position, bolted or otherwise secured to the frame 28 so that the vertical members 68 are rigidly and fixedly secured in position.

Figure 2:
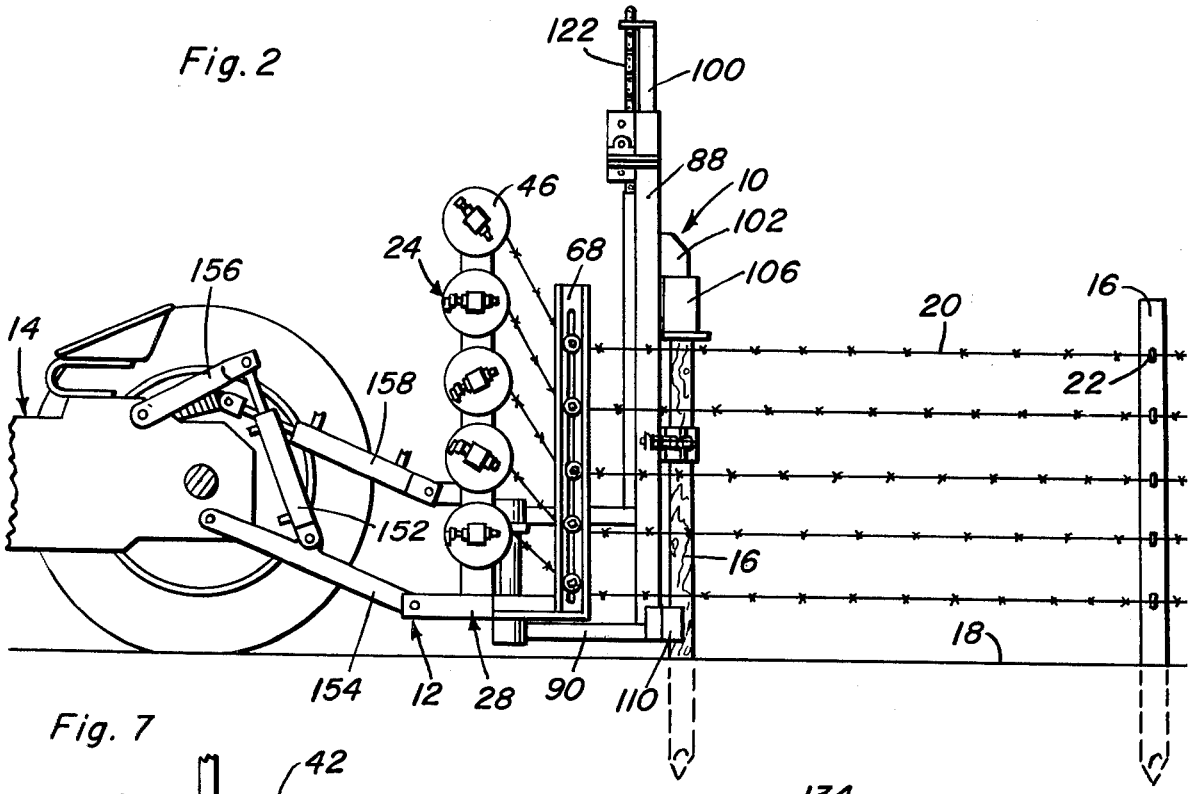
FIG. 2 is a side elevational view of the device in use.
Figure 7:
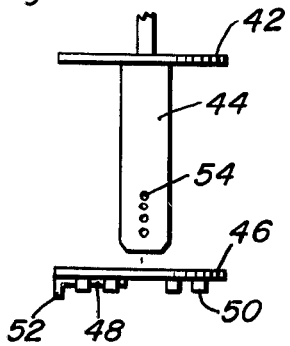
FIG. 7 is a fragmental plan view of one of the wire reels.

Positioned in vertically spaced position and adjustable position between the members 68 is a plurality of guide members each generally designated by reference numeral 74 and each including a threaded inner member 76 and a sleeve 78 thereon. A large washer 80 is disposed on the threaded member 76 against the inner and outer ends of the sleeve 78 and against the inner surface of the support members 68 as illustrated. Each outer end of the threaded members 76 is provided with a smaller washer 82 and a nut 84 which fixedly secures the guide assembly 74 in vertically adjusted position between the support members 68. As illustrated in FIG. 2, the guide members are oriented below the reels 40 so that each wire 20 being unwound from or wound onto a reel will pass under a corresponding guide assembly 74. By vertically adjusting the guide assemblies 74, the vertical spacing between the wire strands 20 may be varied so that equal spacing of the strands may be obtained regardless of the number of strands being employed or, in some instances, the lower or upper strands may be spaced closer or further apart depending upon the requirements of each fence.

Figure 3:
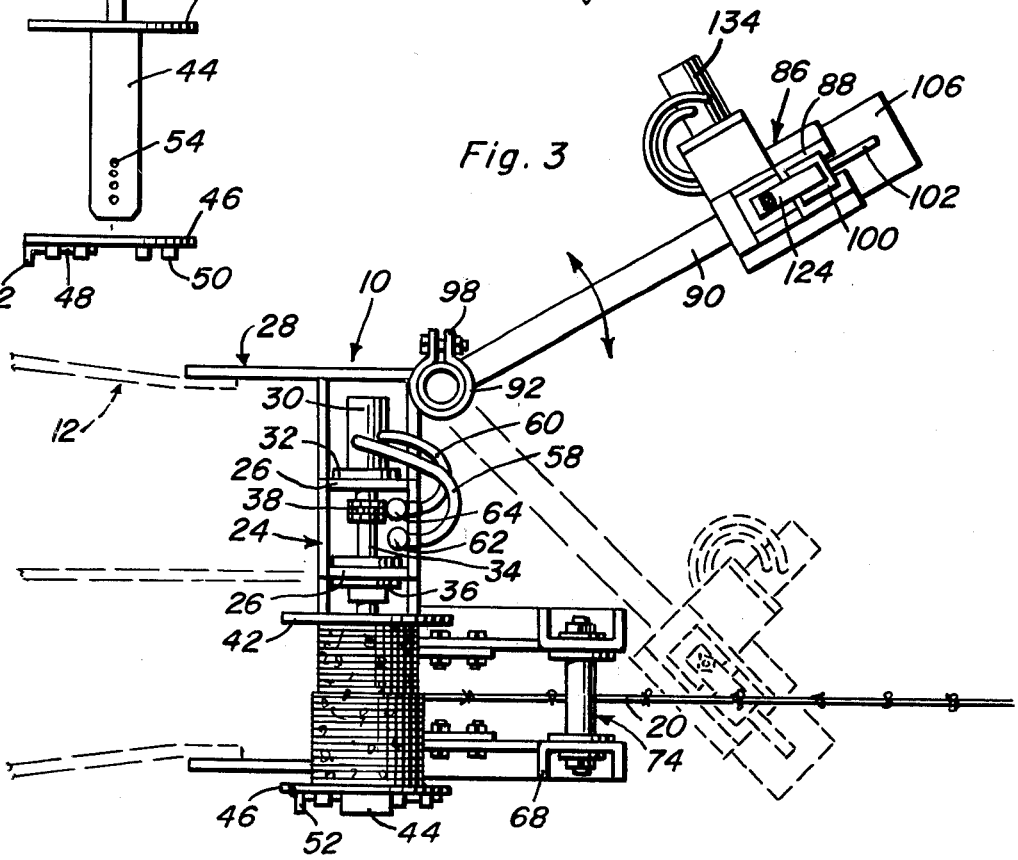
FIG. 3 is a top plan view of the apparatus illustrating the lateral swinging capability of the post setting assembly.
Figure 4:
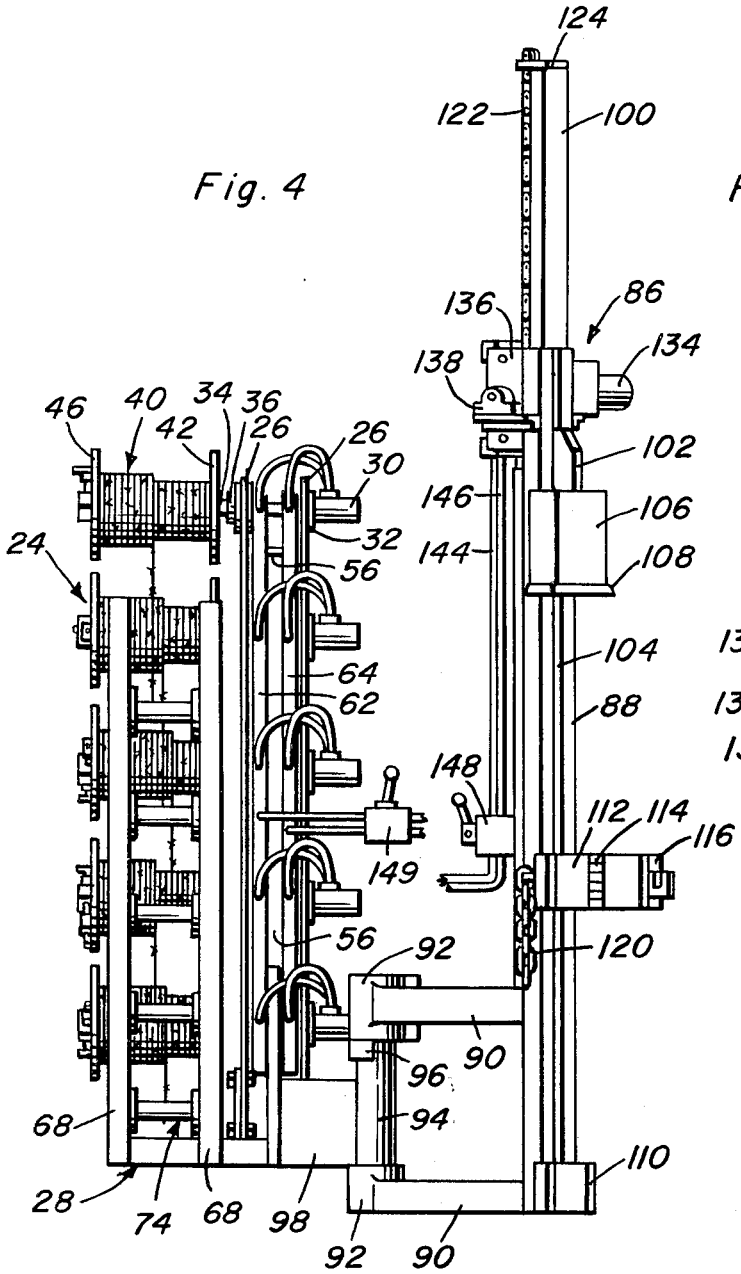
FIG. 4 is an end view of the apparatus.

Supported from the framework 28 is a fence post driving assembly generally designated by numeral 86 and which includes an elongated vertically disposed tubular guide sleeve 88 of preferably square cross-sectional configuration which is rigidly supported from the framework 28 by horizontally disposed parallel support members 90 which have tubular sleeves 92 on their inner ends journaled on the remote ends of a tubular member 94 rigidly secured to a corner of the frame 28 by welding or the like which enables the post driving assembly to be swung about a vertical axis defined by the central axis of the tubular member 94 and the sleeves 92 disposed thereon in the manner illustrated in FIG. 3. The upper sleeve 92 rides on a lug 96 welded to the tubular member 94 and is in the form of a split sleeve having spaced lugs and bolt assembly 98 to lock the post driver in angular position.

Figure 6:
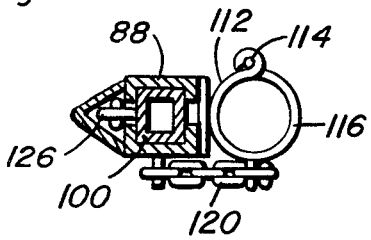
FIG. 6 is a transverse, sectional view taken substantially upon a plane passing along section line 6—6 of FIG. 5 illustrating further structural details of the post driving apparatus.

Reciprocally disposed in the guide sleeve 88 is an elongated tubular member 100 of the same shape as the sleeve 88 and being slidably received therein and relatively close fitting within the interior of the sleeve 88 with the upper end of the member 100 projecting upwardly beyond the upper end of the sleeve 88. On the rear of the member 100, a rearwardly extending plate-like bracket 102 is provided which is vertically oriented and centrally disposed for projection through and longitudinal sliding reception in a longitudinal slot 104 formed in the sleeve 88. Attached to the plate 102 is a block or weight 106 having a plate 108 rigidly fixed to the bottom surface thereof for engagement with the top end of a post 16 as illustrated in FIG. 2. The post 16 being driven is guided and engaged by a generally U-shaped saddle or guide 110 rigidly fixed to the rear of the sleeve 88 adjacent the bottom end thereof which guidingly receives the lower portion of the post adjacent the ground surface when the post 16 is being driven. At the bottom end of the slot 104, a split cylindrical guide 112 is provided with one half of the split cylindrical guide being welded or otherwise fixedly secured to the sleeve 88 and the other half being hingedly attached thereto by a hinge 114. The pivoting portion 116 of the guide 112 is provided with a laterally extending notched lug 118 for receiving a link of a retaining chain 120 so that when the post is positioned in the guide 110 and the guide 112, the movable part 116 of the guide 112 may be pivoted to a closed position, as illustrated in FIG. 6, with the chain 120 serving to retain the guide member 112 in closed condition. Thus, the guide 110 and the guide 112 engage the post 16 at vertically spaced positions and the guide 112 is below the lower end of movement of the weight 106 and plate 108 thereon and serve only to stabilize the post and retain the upper end of the post in alignment with the plate 108 on the weight 106. Thus, with the weight 106 being rigidly fixed to the vertically reciprocal member 100, when the vertically reciprocal member 100 is elevated and released, the weight of the assembly will impact against the top end of the post 16 thus driving the post into the ground in a well known manner.

The structure for elevating the member 100 and the weight 106 thereon is in the form of an elongated sprocket chain 122 having the upper end thereof fixedly secured to a forwardly extending bracket 124 on the upper end of the member 102 and the lower end fixedly secured to a bracket 126 at the lower end of the member 100 with the bracket 126 extending out through a slot 128 in the forward portion of the sleeve 88 with the slot 128 being of a length to enable a complete range of movement of the bracket 126.

Figure 5:
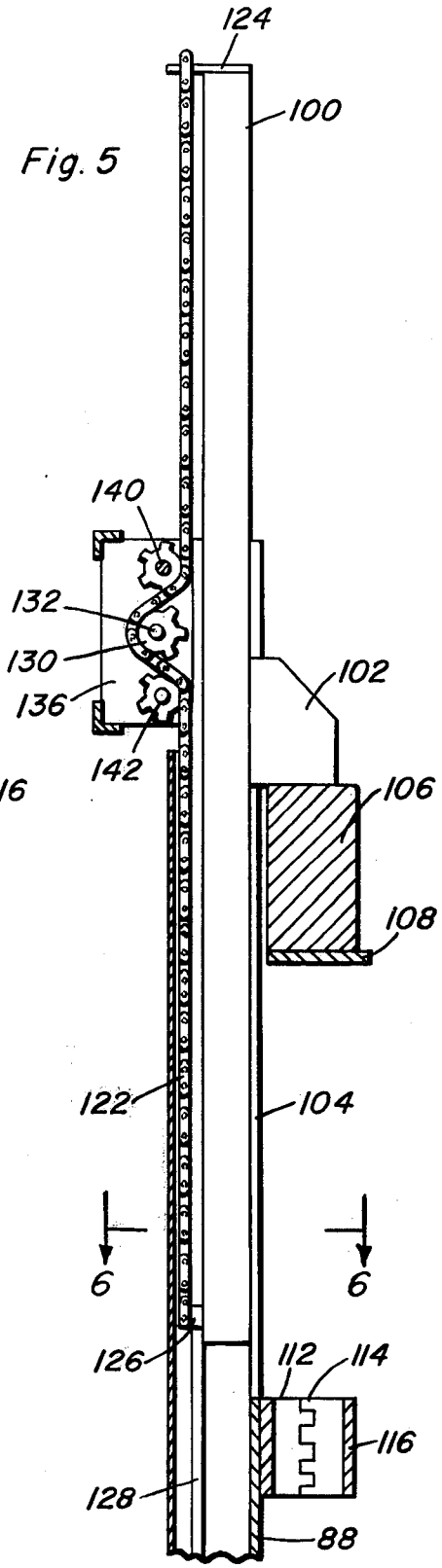
FIG. 5 is a vertical sectional view of the post driving apparatus.

The portion of the sprocket chain 122 between the ends thereof is entrained over a drive sprocket gear 130 mounted on an output shaft 132 of a hydraulic motor 134 which is mounted on and supported by brackets 136 and bearing supports 138 so that as the motor 134 is actuated and the sprocket gear 130 rotated, the rigid mounting of the brackets 136 on the sleeve 88 will cause the member 100 to be elevated. To retain the chain 122 in meshing engagement with the sprocket gear 130, a pair of idler sprocket gears 140 and 142 are provided in engagement with the opposite surface of the sprocket chain from the sprocket gear 130 as illustrated in FIG. 5 with the idler gears 140 and 142 being journaled from shafts carried by the bracket plates 136. Thus, there is a positive drive connection between the hydraulic motor output shaft 132 and the chain 122 and this connection provides for lifting or elevation of the member 100.

The weight 106 may be elevated to a position at the upper end of the sleeve which will have sufficient height to receive a post as long as ten feet with the height of the sleeve being such to enable the weight to be disposed above the upper end of the post a sufficient distance to enable impact to drive the post.

The hydraulic motor 134 is capable of operation in either the pump mode or motor mode and is supplied with hydraulic fluid under pressure through conduits or hoses 144 and 146. When the motor 134 is operating in the motor mode, the hammer 106 is lifted to a desired elevation or to its uppermost elevation and when the hammer 106 or weight 106 is elevated to its desired or limit position, the hydraulic motor 134 then becomes operative in a pump mode without restriction to flow so that the weight or hammer falls free thus driving the hydraulic power unit 134 in a pump mode. This is accomplished by a manual valve arrangement interconnecting the conduits 144 and 146 so that in one position, fluid pressure will flow through the power unit 134 from a source of pressure supply and then return to a supply tank or the fluid will merely circulate from the power unit 134 through the control valve 148 and back to the power unit 134 with the power unit 134 acting as a pump. The control valve 148 may be manually controlled or automatically controlled in response to the elevational position of the hammer 106, that is, when the hammer reaches an elevated position as the power unit 134 is in its motor mode, the valve 148 will automatically be moved to cut off the supply of pressure fluid and enable the fluid to circulate through the power unit 134 without pressure so that the power unit 134 then acts as a pump for circulating the fluid through the valve and the two short conduits 144 and 146. When the hammer is dropped and it reaches its lowermost point of movement the valve can automatically again be shifted to a position so that the power unit 134 becomes a motor. The particular details of this mechanism are not shown but rather only a simple manually actuated device is shown in the form of a valve schematically illustrated in FIG. 1 with it being pointed out that this valve may be oriented in any position and serves to enable the power unit 134 to be operated either in a motor mode or in a pump mode so that when it is in a motor mode, it will be connected to the hydraulic pressure system of the tractor and when in the pump mode, it will be isolated from the hydraulic system of the tractor.

The manifolds 62 and 64 which are communicated with the power units 30 on the reel are likewise connected to the hydraulic fluid pressure system through a control valve 149 which enables the power units 30 to act in a motor mode. In this condition, the power units and the associated conduits are in communication with the hydraulic power system of the tractor for circulating pressurized fluid through the power units 30. The valve 149 may be also positioned so that the power units become operative in a pump mode so that the manifolds and their associated conduits and power units are isolated from the hydraulic system of the tractor and the hydraulic fluid merely circulates through the power units 30 when in their pump mode as well as the conduits or hoses 58 and 60 and the manifolds 62 and 64 with any degree of resistance to flow being provided by the valve 149 thus maintaining a tension on each of the wire strands equal to the flow resistance in the system when the hydraulic fluid is being circulated when the units 30 are in pump mode. The particular details of the valve 149 are not illustrated since this valve along with the valve which controls the hammer are conventional and are associated with a hydraulic power system of a farm tractor in a conventional manner by connecting into the hydraulic system by conventional quick connect couplings or the like so that both the reeling device and the post driving device may be operated when the hydraulic motors on each are in the pump mode or in their motor mode.

Plumbing of the apparatus is accomplished by the use of a doubleacting hydraulic piston and cylinder assembly 152 which extends between the lower link or arm 154 on only one side of the three-point hitch assembly to the corresponding lift arm 156 on that same side thus enabling one side of the frame 28 to be elevated for orienting the apparatus in vertical position laterally of the tractor. The upper control link on the A frame is in the form of a piston and cylinder assembly 158 that is also hydraulically operated and by extending and retracting this piston and cylinder assembly, the wire dispensing device and post driver is oriented vertically with respect to fore-and-aft movements. Control valves are provided for supplying hydraulic fluid from the hydraulic system of the tractor to the hydraulic piston and cylinder assembly or ram 152 and the hydraulic piston and cylinder assembly or ram 158 thereby enabling manual control of the attitude of the hydraulic post driver and wire reeling device with these control valves being conveniently mounted on the framework or upstanding plate structure 26 at a convenient location in order to enable the operator to observe the positioning of the apparatus. A simple leveling device could be provided to indicate vertical orientation in both a lateral direction and a fore-and-aft direction. These control devices are also not illustrated since they are conventional and incorporation of the hydraulic rams 152 and 158 do not alter the existing structure but merely replace the usual connecting link between the lift arm 156 and the lower arm or link 154 and the upper links respectively of a conventional three-point hitch assembly. The connections between the lower links or arms 154 and the frame 28 and the connection between the ram 152, the lower link 154 and the lift arm 156 as well as the connection between the ram 158 and its associated structure enables sufficient movement of the apparatus to orient it vertically so that the posts may be vertically oriented regardless of the inclination of the terrain on which the tractor rests.

The swinging of the apparatus in an arcuate direction as illustrated in FIG. 3 enables the post driver to be disposed laterally of the tractor. This enables the tractor to be stationary or driven parallel to a ditch line, timber line or existing fence structure and posts to be driven at a position spaced laterally of the tracking of the wheels of the tractor. While in actual practice, the drop hammer weighs approximately 185 pounds which has been found to be adequate in most instances, additional weight can be added depending upon the conditions encountered. The wire reeling device serves as a wire stretcher and can string from one to five strands of wire and has the ability to rewind a roll of wire as quickly and effectively as it has been stretched. This device enables wire of various types and spacings to be strung and greatly increases the quantity of fencing which can be installed in a given period of time. Also, if desired, a post may be pulled from the ground by using a rope, chain or other structure wrapped around the post adjacent the post guide structures and also wrapped around the sleeve 88 in the form of a half hitch to enable the hydraulic three-point system to elevate the entire apparatus and pull a post from the ground.

The foregoing ia considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An apparatus for driving fence posts or the like into the ground, said apparatus comprising a support framework, a weighted driving member carried by said framework for generally vertical reciprocation, lift means connected to said driving member for raising said driving member to an elevated position and permitting free fall of said weighted driving member to engage the upper end of a post for driving it into the ground, said lift means including a hydraulic motor adapted to be operable in either a motor mode when lifting the driving member or a pump mode when permitting the driving member to free fall, said driving member including an elongated member, said framework including a sleeve slidably guiding said elongated member, an elongated chain mounted alongside of said elongated member and having end portions thereof anchored to respective end portions of the elongated member, drive sprocket means on said hydraulic motor continuously engaged with the chain for moving the chain and elongated member generally vertically when the sprocket means is driven by the hydraulic motor when in a motor mode, said elongated member including a horizontal post engaging member intermediate the ends thereof for engaging the upper end of a fence post.

2. The structure as defined in claim 1 wherein said guide sleeve is vertically elongated, said sleeve including a longitudinally extending slot therein enabling movement of the lower end of the chain, and post receiving and guiding means associated with said sleeve for retaining the post in substantially vertical position and guiding the post during its downward movement.

3. The structure as defined in claim 2 wherein said framework includes a pair of arms rigid with the sleeve, a supporting assembly adapted to be connected with a three-point hitch of a tractor, said supporting assembly including a pivot connecting means for the arms to enable the arms and sleeve to swing laterally about substantially a vertical axis to enable the fence post driver to be oriented in overlying relation to the upper end of a post oriented alongside of a tractor for enabling a fence to be strung in a position laterally of the tractor.

4. The structure as defined in claim 3 wherein said supporting assembly includes a hydraulic piston and cylinder assembly utilized between the lower arm and lift arm on one side of the three-point hitch to adjust the framework about an axis longitudinally of the tractor and a hydraulic piston and cylinder assembly as the upper arm in a three-point hitch assembly to adjust the framework in a fore-and-aft direction about a transverse axis thereby enabling the guide sleeve to be positioned vertically for driving a post vertically into the ground regardless of the uneven terrain on which the tractor may rest.

5. The structure as defined in claim 1 wherein said framework includes an upstanding supporting member generally paralleling the sleeve and elgonated member and located adjacent the sleeve, a plurality of hydraulic motors mounted on the supporting member, each of said motors including a drive shaft and being operable in either a motor mode or a pump mode, wheel means drivingly connected to each of said drive shafts for storing and dispensing wires, first and second hydraulic fluid manifolds communicating with said motors and adapted to be communicated with a fluid pressure source wherby fluid flow into a motor from said first manifold is effective to operate said motor in a motor mode and fluid flow in an opposite direction being effective to operate the fluid motor in a pump mode, said fluid motors being connected in parallel to each other and relative to said first and second manifolds whereby said fluid motors are independent of each other to assure constant tension on any one wire independently of the other wires when the motors are in motor mode or pump mode.

6. The structure as defined in claim 5 wherein the drive shaft of each motor includes a hub forming an extension of the drive shaft, said reel means including spaced end disks on said hub, the end disk remote from the motor being removable to enable a spool of wire to be placed on the hub or removed therefrom, wire guide means disposed adjacent each of the reel means, said guide means including a vertically supported member, a plurality of vertically spaced horizontally disposed guide members supported therefrom with each guide being disposed below a corresponding hub and reel means thereon for guiding the wires from the reel means or onto the reel means, means supporting the guides on the vertical support member for vertical adjustment for enabling variation in the spacing of the wires, said guides and reel means being oriented so that wires passing therefrom or being wound onto the reel means will be oriented alongside of a line of fence posts to facilitate dispensing of or reeling in of fence wires, the hub on each of said reel means including a series of apertures adjacent the end thereof remote from the motor, said removable end disk being slidable on the hub and including a radially movable lockpin mounted thereon for engagement with one of the holes in the hub, each of said guides including a cylindrical tubular member, a threaded inner member received in said tubular member and extending through and being rigidly fixed to the vertical support member, said vertical support member including an elongated slot enabling vertical adjustment of the guides.

7. The structure as defined in claim 1 wherein said sprocket means is in the form of a sprocket gear in continuous engagement with said chain, said chain being in the form of a sprocket chain entrained over a substantial portion of the periphery of the sprocket gear, said post engaging member on said elongated member extending laterally of the sleeve to enable association of the post engaging member with the upper end of a post without interference from the sleeve, said sleeve being elongated with the hydraulic motor and sprocket gear being fixed to the upper end thereof, said sleeve having a longitudinal slot therein remote from the motor and sprocket gear through which said post engaging member extends, said support framework including means supporting the sleeve, elongated member, hydraulic motor and post engaging member for pivotal movement about a generally vertical axis spaced from the post engaging member to enable the sleeve, elongated member, motor and post engaging member to be swung laterally about a vertical axis for positioning the post engaging member into overlying relation to the upper end of a post when the support framework is located laterally of a line of fence posts.

8. An apparatus for driving fence posts or the like into the ground, said apparatus comprising a support framework, a weighted driving member carried by said framework for generally vertical reciprocation, lift means connected to said driving member for raising said driving member to an elevated position and permitting free fall of said weighted driving member to engage the upper end of a post for driving it into the ground, said lift means including a hydraulic motor adapted to be operable in either a motor mode when lifting the driving member or a pump mode when permitting the driving member to free fall, said driving member including an elongated member, said framework including a sleeve slidably guiding said elongated member, an elongated chain mounted alongside of said elongated member and having the ends thereof anchored to the respective ends of the elongated member, drive sprocket means on said hydraulic motor engaged with the chain for moving the chain and elongated member generally vertically when the sprocket gear is driven by the hydraulic motor when in a motor mode, said elongated member including a laterally extending plate member having a weight associated therewith for engaging the upper end of a fence post, said guide sleeve being vertically elongated, said sleeve including a longitudinally extending slot therein enabling movement of the lower end of the chain, and post receiving and guiding means associated with said sleeve for retaining the post in substantially vertical position and guiding the post during its downward movement, said framework including a pair of arms rigid with the sleeve, a supporting assembly adapted to be connected with a threepoint hitch of a tractor, said supporting assembly including a pivot connecting means for the arms to enable the arms and sleeve to swing laterally about substantially a vertical axis to enable the fence post driver to be oriented in overlying relation to the upper end of a post oriented alongside of a tractor for enabling a fence to be strung in a position laterally of the tractor, said supporting assembly including a hydraulic piston and cylinder assembly utilized between the lower arm and lift arm on one side of the three-point hitch to adjust the framework about an axis longitudinally of the tractor and a hydraulic piston and cylinder assembly as the upper arm in a three-point hitch assembly to adjust the framework in a fore-and-aft direction about a transverse axis thereby enabling the guide sleeve to be positioned vertically for driving a post vertically into the ground regardless of the uneven terrain on which the tractor may rest, said framework including an upstanding supporting plate generally paralleling the sleeve and elongated member and located between the connection to the three-point hitch and the sleeve, a plurality of hydraulic fluid motors mounted on the supporting plate, each of said motors including a drive shaft and being operable in either a motor mode or a pump mode, reel means drivingly connected to each of said fluid motor drive shafts for storing and dispensing wires or the like, first and second hydraulic fluid manifolds communicating with said motors and adapted to be communicated with a fluid pressure source whereby fluid flow into a fluid motor from said first manifold is effective to operate said motor in a motor mode and fluid flow in an opposite direction being effective to operate the fluid motor in a pump mode, said fluid motors being connected in parallel to each other relative to said first and second manifolds whereby said fluid motors are independent of each other to assure constant tension on any one wire independently of the other wires when the motors are in motor mode or pump mode.

9. The structure as defined in claim 8 wherein the drive shaft of each motor includes a hub forming an extension of the drive shaft, said reel means including spaced end disks on said hub, the end disk remote from the hydraulic motor being removable to enable a spool of wire to be placed on the hub or removed therefrom.

10. The structure as defined in claim 9 together with guide means interposed between each of the reel means and the post driver, said guide means including a vertically supported plate assembly, vertically spaced horizontally disposed guide members supported from the plate assembly with each guide being disposed below a corresponding hub and reel means thereon for guiding the wires from the reel means or onto the reel means, means supporting the guides for vertical adjustment on the plate assembly for enabling variation in the spacing of the wires, said guides and reel means being oriented so that wires passing therefrom or being wound onto the reels will be disposed alongside of a line of fence posts being driven by the post driver.

* * * * *